United States Patent [19]

Chezem et al.

[11] Patent Number: 4,514,000

[45] Date of Patent: Apr. 30, 1985

[54] SPRING BIASED DOOR STOP HAVING A VERTICALLY MOVABLE TENSION MEMBER

[75] Inventors: Jimmie A. Chezem, Sparta; Gary E. Burks, Pikeville, both of Tenn.

[73] Assignee: Plateau Products Corporation, Sparta, Tenn.

[21] Appl. No.: 459,590

[22] Filed: Jan. 20, 1983

[51] Int. Cl.[3] ..... E05C 17/54

[52] U.S. Cl. ..... 292/338; 292/339; 292/DIG. 15

[58] Field of Search ..... 16/82, 85, 86 R, DIG. 39, 16/DIG. 41; 292/338, 339, 341.17, 341.18, 342, 343, 348, 355, DIG. 15

[56] References Cited

U.S. PATENT DOCUMENTS

| | | | |
|---|---|---|---|
| 1,915,795 | 6/1933 | MacMillan | 292/DIG. 15 X |
| 1,921,568 | 8/1933 | Hasselberger | 292/DIG. 15 X |
| 3,737,186 | 6/1973 | Chezem | 292/DIG. 15 X |

*Primary Examiner*—Fred A. Silverberg
*Attorney, Agent, or Firm*—Harvey B. Jacobson

[57] ABSTRACT

A base is provided for stationary mounting from a door and includes an elongated upright guide for positioning against the surface of the door which faces in the direction in which the door is moved toward the open position and with the guide located adjacent the lower marginal edge portion of the door near the free swinging edge thereof. A vertically elongated prop member is pivotally mounted at its upper end from an upper portion of the guide for oscillation about a horizontal axis generally paralleling the door surface and for movement between a first inoperative downwardly and outwardly inclined position with the lower end of the prop member spaced above the lower marginal edge of the door and a second operative position with the lower end of the prop member swung toward the door and projecting at least slightly below the door lower marginal edge for engagement with a horizontal surface, such as a floor, over which the lower marginal edge moves when the door is moved toward the open position thereof. The prop member is yieldingly biased toward the inoperative position and an elongated tension member extends between the guide and prop member and includes opposite end portions slidably anchored to the guide and prop member for guided gravity biased movement downwardly therealong. A first form of the invention is permanently mounted on the associated door and a second form of the invention is portable and may be quickly removably mounted on an associated door.

15 Claims, 9 Drawing Figures

Fig. 1
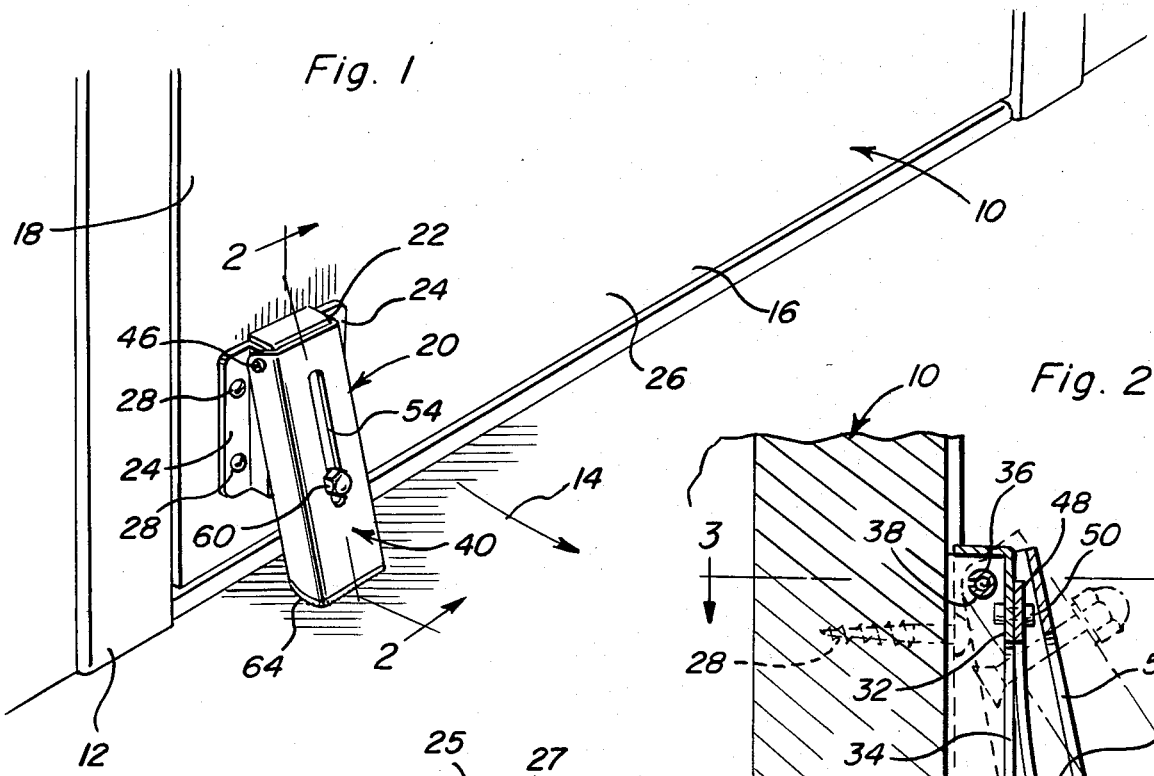
Fig. 2
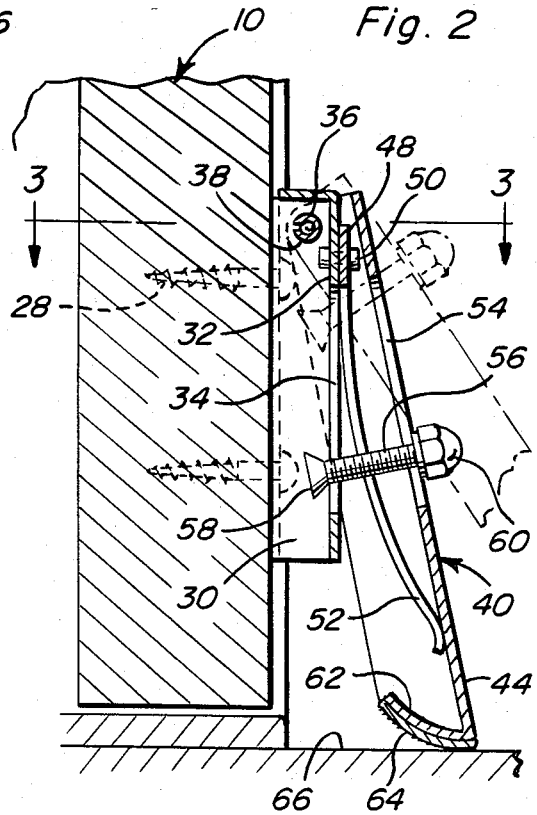
Fig. 4
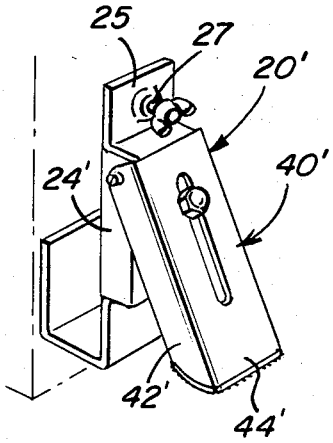
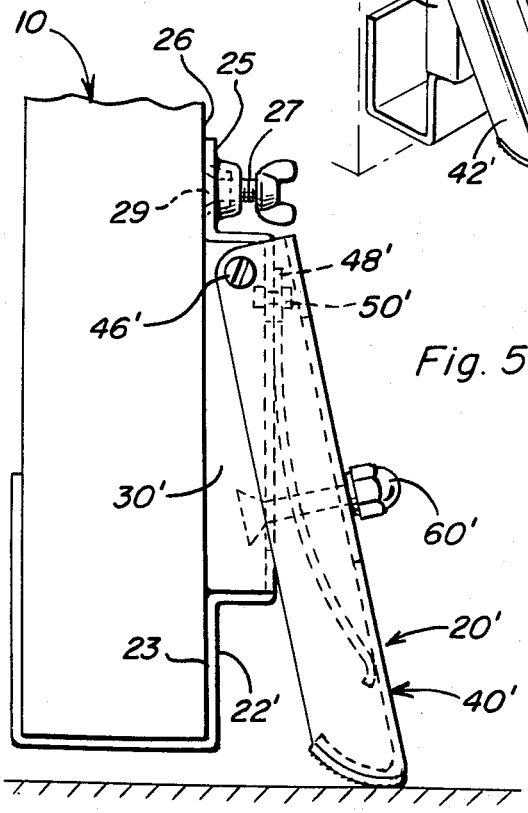
Fig. 5
Fig. 3
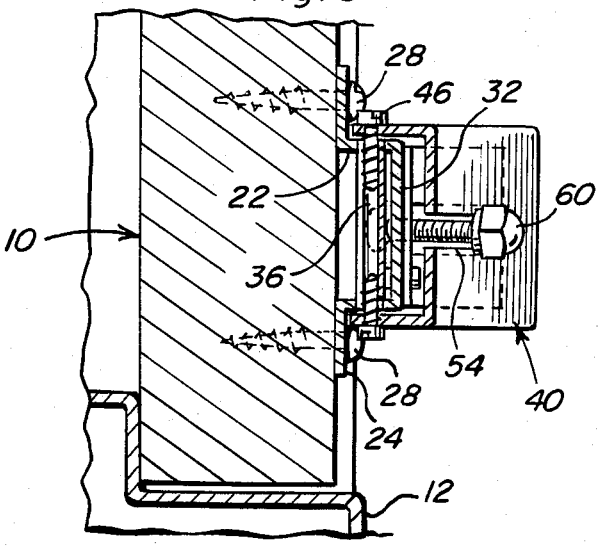

Fig. 6
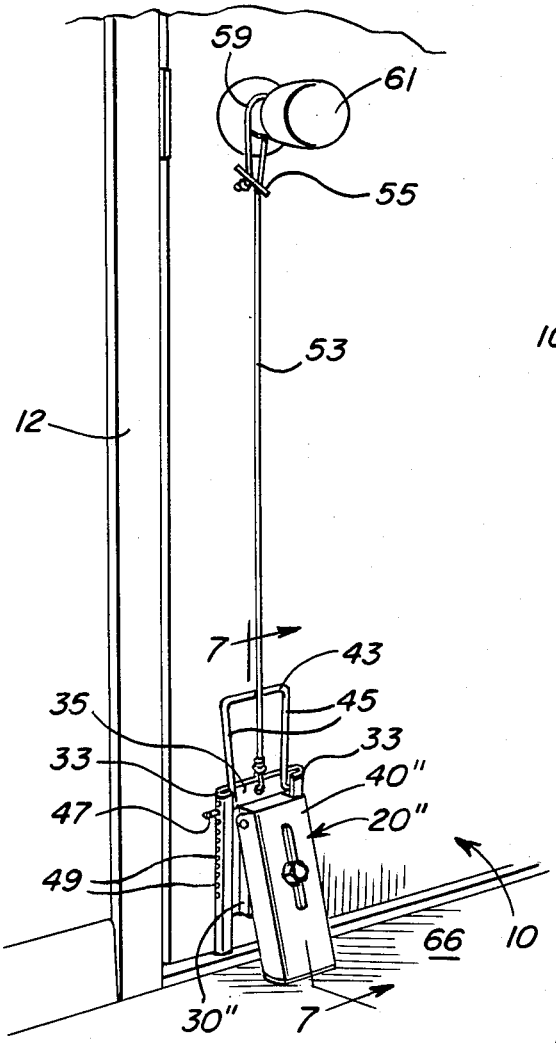
Fig. 7
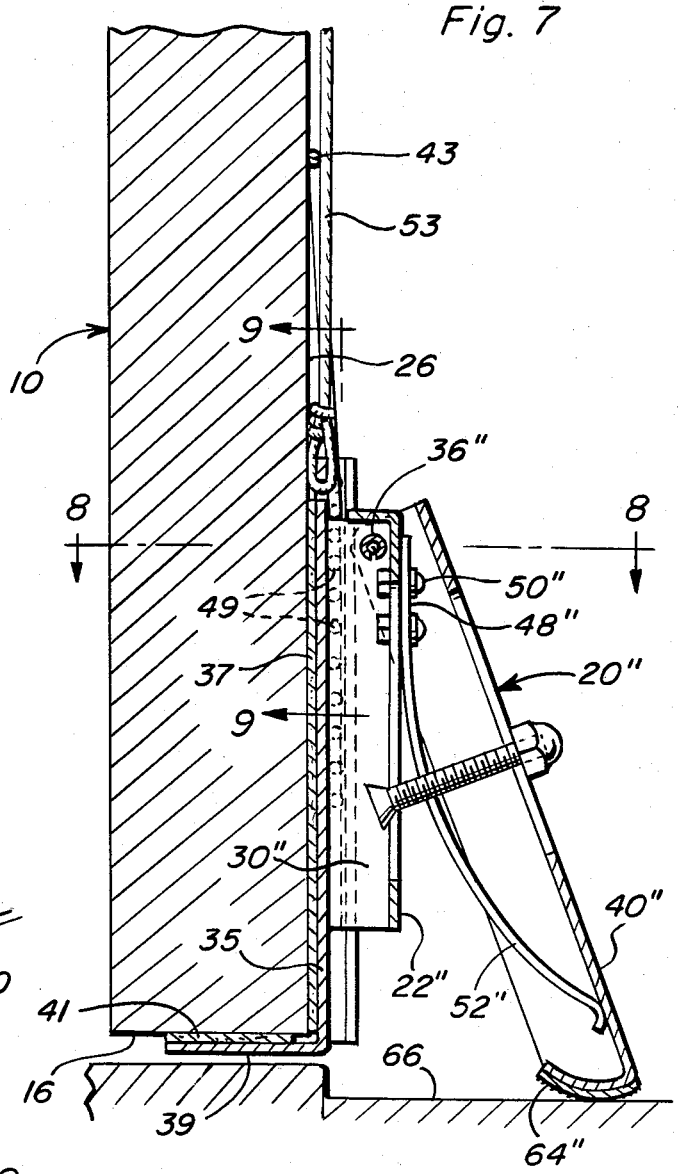
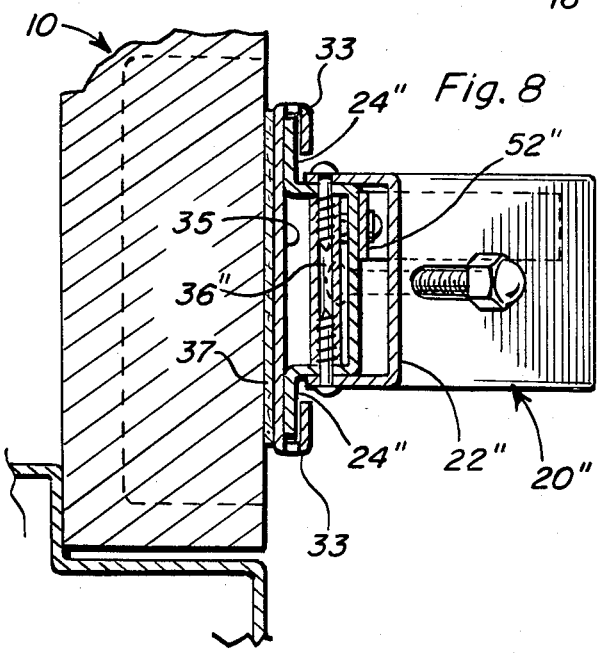
Fig. 8
Fig. 9
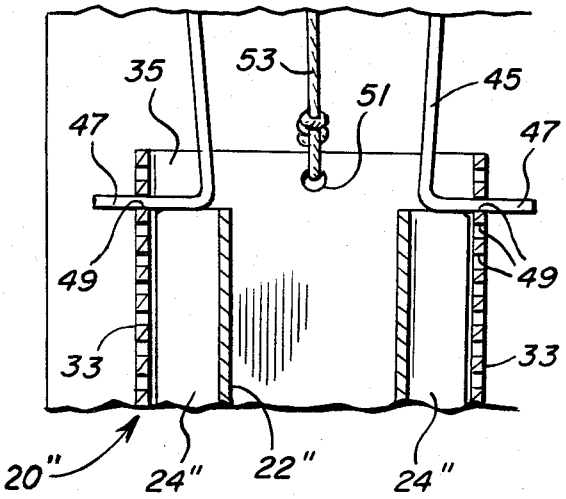

SPRING BIASED DOOR STOP HAVING A VERTICALLY MOVABLE TENSION MEMBER

BACKGROUND OF THE INVENTION

Various different types of closure doors are provided with different forms of locks whereby the doors may be locked in the closed positions. However, recent increases in breaking and entering and other forms of crime wherein perpetrators of crime gain entrance into a locked door secured area while persons are in those areas has created near panic situations in some areas of high crime frequency with the result that many persons are utilizing double and even triple locks on doors. However, the utilization of double and triple key operated locks on doors requires the use of additional keys and unnecessarily increases the number of door locking keys which must be carried and replaced, if lost. Furthermore, it is reasonably well established that most homes can be broken into when the homes are unoccupied through forced entries other than be forcing a locked door. Accordingly, the main interest in providing a more secure door lock is to prevent entry through the door while the home is occupied.

It is therefore apparent that a non-key operated lock needs to be provided as a door locking device which may be actuated by a person within a home or the like without the use of a key and with little expense.

BRIEF DESCRIPTION OF THE INVENTION

The door stop or lock of the instant invention, in a first form thereof, is constructed in a manner whereby it may be readily attached to the inner surface of a door and utilized either independent of or in conjunction with a conventional key operated door lock in order to increase the locked security of a door by a person disposed within the area secured by the locked door.

The door stop or lock is constructed in a manner such that it also may be used as a replacement for a "night chain" type of lock wherein an associated door may be partially opened and prevented from being further opened, if desired.

A second form of the door lock is constructed in a manner whereby it may be readily temporarily mounted upon an associated door of a hotel or motel room and the like and thus carried by a traveler in order that he or she may rest assured that entry into his or her motel or hotel room will be prevented while the room is occupied.

The main object of this invention is to provide a supplemental door lock which may be used to securely lock a door from being opened from the inside and which does not require the use of a key.

Another object of this invention is to provide a door lock which may also function as a "night chain".

Still another important object of this invention is to provide a door lock which may be readily mounted upon an associated door through the utilization of simple tools.

A further object of this invention is to provide a door lock in accordance with the preceding objects and of the portable type whereby the door lock may be carried by a traveler and quickly operatively associated with a motel or hotel room door, if desired.

A final object of this invention to be specifically enumerated herein is to provide a door lock in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view illustrating the manner in which a first form of door lock constructed in accordance with the present invention may be operatively semi-permanently mounted on the interior of a door;

FIG. 2 is an enlarged fragmentary vertical sectional view taken substantially upon the plane indicated by the section line 2—2 of FIG. 1 and illustrating an inoperative position of the door locking portion of the invention in phantom lines;

FIG. 3 is a horizontal sectional view taken substantially upon the plane indicated by the section line 3—3 of FIG. 2;

FIG. 4 is a perspective view of a modified form of door lock adapted for ready removable support from a hotel or motel room door;

FIG. 5 is an enlarged edge elevational view of the modified form of door lock illustrated in FIG. 4 as mounted on a door;

FIG. 6 is a fragmentary perspective view similar to FIG. 1, but illustrating a third form of door lock to be removably supported from a hotel or motel room door and including structure whereby variations in the height of the lower edge of the door above the floor surface on the inside of the door may be compensated for;

FIG. 7 is an enlarged vertical sectional view taken substantially upon the plane indicated by the section line 7—7 of FIG. 6;

FIG. 8 is a horizontal sectional view taken substantially upon the plane indicated by the section line 8—8 of FIG. 7; and FIG. 9 is a vertical sectional view taken substantially upon the plane indicated by the section line 9—9 of FIG. 7.

DETAILED DESCRIPTION OF THE INVENTION

Referring now more specifically to the drawings the numeral 10 generally designates a horizontally swingable door mounted in a door frame or jamb 12. The door 10 is swingable in the direction of the arrow 14 toward an open position. The door 10 includes a lower marginal edge portion 16 and a free swinging edge portion 18.

The door stop or lock of the instant invention is referred to in general by the reference numeral 20 and includes a vertically disposed generally U-shaped base 22 including oppositely laterally outwardly directed and apertured mounting flanges 24 by which the base 22 is secured to the inner surface 26 of the door 10 through the utilization of suitable threaded fasteners 28. The base 22 includes parallel legs 30 between which a bight portion 32 extends and the bight portion 32 includes a central longitudinally extending and vertically disposed slot 34 formed therethrough for a purpose to be more fully set forth.

A split rolled pin 36 has its opposite ends rotatably received within aligned apertures 38 provided therefor in the upper ends of the legs 30 and the door stop 20 further includes a vertically elongated prop member referred to in general by the reference numeral 40 which is also U-shaped in configuration and includes a pair of parallel opposite side legs 42 and a connecting bight portion 44. The prop member 40 is of slightly greater width than the channel shaped base and the upper end of the prop member 40 loosely receives the upper end of the base 22 therein with threaded pivot fasteners 46 being secured through suitable apertures provided therefor in the legs 42 and threadedly engaged in the adjacent ends of the rolled pin 36. In this manner, the prop member 40 is pivotally supported from the base 22.

A slotted leaf spring 48 is provided and is secured by rivots 50 to the upper end portion of the bight portion 32 and includes arcuate spring fingers 52 which engage and yieldingly outwardly bias the lower end of the bight portion 44 of the prop member 40. The bight portion 44 is provided with a longitudinal slot 54 registered with the slot 34 and an elongated rigid tension member 56 is provided and is slidably received in the slots 34 and 54 with one end of the tension member 56 provided with a conical head 58 and a removable head 60 being disposed on the other end. The heads 58 and 60 are disposed on remote sides of the slots 34 and 54. Further, the lower end of the bight portion 44 includes an inturned arcuate end 62 having a non-slip panel 64 secured thereon.

In operation, when the prop member 40 is deflected slightly inwardly toward the lower marginal edge portion 16 of the door 10, the head 60 and the attached tension member 56 may be displaced upwardly toward the upper ends of the slots 34 and 54 whereby inward pressure on the lower end of the prop member 44 may be released and the spring fingers 52 will yieldingly bias the lower end portion of the prop member 40 upwardly and outwardly toward the phantom line position illustrated in FIG. 2 of the drawings with the lower end of the prop member 40 spaced appreciably above the floor 66. When the prop member 40 is swung to the inoperative position illustrated in phantom lines in FIG. 2, the door 10 may be swung inwardly along the path 14 toward the open position thereof.

If it is desired to lock the door 10 in the closed position illustrated in FIG. 1, after the door is closed inward foot pressure may be applied to the lower end of the prop member 40 to swing the latter inwardly from the phantom dotted line position thereof illustrated in FIG. 2 to the solid line position of FIG. 2 with the lower end of the prop member 40 engaged with the floor 66. As the prop member 40 is swung inwardly toward the solid line position of FIG. 2, the tension member falls, by gravity, to the solid line position thereof illustrated in FIG. 2 and thus prevents movement of the prop member back to the inoperative position illustrated in phantom lines in FIG. 2. Thus, any attempt to open the door 10 is prevented by the prop member 40.

Still further, if the door is to be opened only slightly from the closed position thereof illustrated in FIG. 10, the prop member 40 may be initially released for swinging toward the phantom line position illustrated in FIG. 2 and as the door 10 is opened slightly foot pressure may be applied to the lower end of the prop member 40 in order to engage the floor 66 therewith. Any attempt to further open the door will of course be resisted by the prop member 40 and any subsequent slight movements of the lower marginal edge portion 16 of the door 10 toward the closed position which may be effected by a person disposed on the inside of the door 10 will result in the lower end of the prop member 40 gaining further engagement with the floor 66 at points spaced closer to the jamb or frame 12.

With attention invited now more specifically to FIGS. 4 and 5 of the drawings, there may be seen a modified form of door stop referred to in general by the reference numeral 20'. The various components of the door stop 20' which correspond to similar components of the door stop 20 are designated by prime reference numerals given the corresponding components of the door stop 20. The door stop 20' differs from the door stop 20 in that the lower end of the base 22 includes a U-shaped portion 23 which removably embracingly engages the lower marginal edge portion of the door 16 and may be engaged with the lower marginal edge portion of the door 16 when the prop member 40' is in the raised inoperative position and the free swinging edge of the door 18 has been swung away from the jamb or frame 12. In addition, the upper portion of the base 22 includes an apertured flange portion 25 through which a thumb head equipped screw shaft 27 is threaded and the inner end of the screw shaft 27 includes an enlarged abutment head 29 which is engageable with the inner surface 26 of the door 10. In this manner, the modified form of door stop 20' may be removably clamped to the door 10. Otherwise, the structure and operation of the door stop 20' is identical to the structure and operation of the door stop 20.

It is to be noted that spring means other than the leaf spring 48 may be used to yieldingly bias the prop member 40 to the raised inoperative position. Further, the non-slip panel or coating 64 may be replaced by a resilient block, if desired. Also, the outer edge of the lower end of the prop member 40 may be provided with a resilient abutment block in order that the door stop 20 may also function as a cushioning member to cushion full opening movement of the door 10 back against the wall from which the door 10 is pivoted.

With attention now invited to FIGS. 6, 7, 8 and 9 of the drawings, there may be seen a second modified form of door stop referred to in general by the reference numeral 22" and which is substantially identical to the door stop 20, except that the U-shaped base 22" corresponding to the base 22 may or may not be provided with openings for receiving fasteners such as the fasteners 28 through the flanges 24" of the U-shaped base 22". Rather, instead of utilizing fasteners such as the fasteners 28 to secure the U-shaped base 22 to the inner face of the door 10, the flanges 24" are slidably received in opposing opposite side channel portions 33 of a mounting plate 35 backed by a resilient pad 37. In addition, the door lock 20" includes only a single arcuate spring finger 52" corresponding to the spring fingers 52. The elements denoted by numerals 36", 48", 50", 52" and 64" in FIGS. 7 and 8 are the same as those disclosed in the previous Figures except for the " which denotes the FIGS. 6–9 embodiment.

The lower end of the mounting plate 35 includes a right angle flange portion 39 equipped with a resilient pad 41 and flange 39 is received beneath the lower marginal edge portion 16 of the door 10 in the manner illustrated in FIG. 7 of the drawings with the resilient pad 37 abutting against the inner surface 26 of the door 10. In addition, a U-shaped bail 43 is provided and constructed of spring-type rod material. The free ends of the legs 45 of the bail 43 include outturned terminal ends 47 which are removably received through corresponding longitudinally spaced bores 49 formed in the channel portions 33. The terminal ends 47 limit upwardly sliding movement of the flanges 24'' in the channel portions 33 and the upper marginal edge of mounting plate 35 is provided with an aperture 51 through which one end of an elastic (nylon) tension member 53 is secured. The other end of the tension member 53 is equipped with a loop-forming strip 55 having one end anchored relative to the tension member 53 and slidably receiving an intermediate length portion of the tension member 53 through the other end. Accordingly, the strip 55 forms a loop 59 in the end of the tension member 53 remote from the mounting plate 35 and the loop 59 amy be passed over the door knob 61 supported from the door 10. Thereafter, the strip 55 may be pulled downwardly along that portion of the tension member 53 extending between the knob 51 and the mounting plate 35 in order to tightly tension that portion of the tension member. In this manner, the mounting plate 35 may be securely anchored relative to the inner side and lower marginal edge portion of the door 10 independent of the door 10 being open. After the door lock 20'' has been mounted on the door 10, the prop member 40'' thereof corresponding to the prop 40 may be readily inwardly and downwardly displaced into tight engagement with the floor 66 inwardly of the door 10.

It will be noted that the door lock 20 may be readily converted into a door lock 20'' merely by the addition of the mounting plate 35, bail 43 and tension member 53 to the basic structure of the door lock 20.

If the lower marginal edge portion 16 of the door 10 is appreciably spaced above the floor surface 66 inwardly of the door 10, the terminal ends 47 of the bale 43 may be inserted through bores 49 spaced lower along the channel portions 33. Conversely, if the level of the floor surface 66 is only slightly below the lower marginal edge of the door 10, the terminal ends 47 may be inserted through corresponding bores 49 spaced further upward along the channel portions 33.

Still further, it is also possible to provide the intured flange 39 with an upwardly directed flange such as the outer flange of the U-shaped portion 23 thereby providing a U-shaped portion at the bottom of the mounting plate 35. However, in order to install a door stop or lock 20'' equipped in this manner, it would be necessary to open the door in order that the U-shaped portion could be slid into engagement with the lower marginal edge of the door from the free swinging edge thereof. Accordingly, and particularly inasmuch as the tension member 53 provides ample mounting of the mounting plate 35 on the door 10, in many instances it will be desirable to provide a portable door lock or stop which is constructed in the manner of the door lock 20'' as opposed to the door lock 20'.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A door stop including a base for stationary mounting upon a door and including an elongated upright guide for support adjacent the lower marginal edge portion of the surface of the door which faces in the direction in which the door is moved toward the open position, a vertically elongated prop member pivotally mounted at its upper end from an upper portion of said guide for oscillation about a horizontal axis generally paralleling said surface and for movement between a first inoperative downwardly and outwardly inclined position with the lower end of the prop member disposed at a high level and a second operative position with the lower end of said prop member swung inward and downward to a low level to project at least slightly below said lower marginal edge portion for engagement with a horizontal surface over which said lower marginal edge moves when said door is shifted toward the open position thereof, means operatively connected between said base and prop member yieldingly biasing the latter toward said inoperative position, and elongated tension member means extending between said guide and prop member and including opposite end portions thereof slidably anchored to the guide and prop member for guided gravity movement downwardly therealong and with said tension member means preventing movement of said prop member toward said inoperative position from an operative position thereof independent of upward movement of said tension member means along said prop member and guide, wherein said guide and prop member include registered upstanding slots formed therethrough, said tension member means comprising an elongated tension member having its opposite ends slidably received through said slots and equipped with enlarged head means on the terminal ends thereof disposed on remote sides of said slots, wherein said tension member includes an elongated rigid rod member, the length of said rigid rod member enabling the prop member to swing to said inoperative position when the rigid member is moved upwardly in the slots toward the pivot axis, said rigid member falling by gravity away from the pivot axis as the prop member swings toward said operative position until the lower end thereof contacts the floor, said rigid member automatically and positively retaining the prop member in any position to which it is moved when the lower end contacts the floor.

2. The door stop of claim 1 wherein said means operatively connected between said base and prop member yieldingly biasing the latter toward said inoperative position comprises a leaf spring having longitudinally spaced portions thereof engaged with said prop member and guide.

3. The door stop of claim 1 wherein the lower end of said prop member includes a non-slip undersurface portion.

4. The door stop of claim 1 wherein said base includes a pair of coplanar apertured mounting flanges through which fasteners may be secured for mounting said base on a door with said mounting flanges abutting the inner surface of said door.

5. The door stop structure of claim 1 wherein said base includes an upwardly opening generally channel shaped lower portion for embracingly engaging the lower marginal portion of a door and an upper portion of said base includes a threaded abutment screw supported therefrom for abuttingly engaging the inner surface of a door.

6. The door stop of claim 1 wherein the base and prop members include nested and relatively pivotable channel members of generally U-shaped cross section with the axis of relative oscillation thereof extending transversely of the channel members, the bight portions of said channel members being provided with registered longitudinal slots.

7. The door stop structure of claim 6 wherein said means operatively connected between said base and prop member yieldingly biasing the prop member toward said inoperative position comprises a leaf spring having longitudinally spaced portions thereof engaged with said prop member and guide.

8. The door stop structure of claim 7 wherein the lower end of said prop member includes a non-slip undersurface portion.

9. The door stop structure of claim 8 wherein said base includes a pair of coplanar apertured mounting flanges through which fasteners may be secured for mounting said base on a door with said mounting flanges abutting the inner surface of said door.

10. The door structure of claim 8 wherein said base includes an upwardly opening generally channel-shaped lower portion for embracingly engaging the lower marginal portion of a door and an upper portion of said base includes a threaded abutment screw supported therefrom for abuttingly engaging the inner surface of a door.

11. The door stop of claim 1 wherein said base includes a pair of coplanar mounting flanges, a mounting plate defining opposing opposite side channel portions opening toward each other and in which said mounting flanges are slidingly received, one marginal edge portion of said mounting plate extending transversely of and being disposed adjacent one pair of corresponding ends of said channel portions and including means engaging the lower marginal edge portion of an associated door, said channel portions being provided with longitudinally spaced pairs of registered bores, abutment pin means receivable through a selected pair of registered bores and engageable by said flanges to limit sliding movement of said base away from said one marginal portion of said mounting plate, the marginal edge portion of said mounting plate remote from said one marginal edge portion thereof having one end of elastic tension member means anchored relative thereto, the other end of said elastic tension member means including means for forming an adjustable size loop for passage over an associated door knob.

12. The door stop of claim 11 wherein said abutment pin means comprise oppositely laterally outwardly directed terminal ends of the legs of a generally U-shaped bail constructed of resilient material.

13. In combination with a door including a lower marginal edge and a leading surface which faces in the direction in which said door moves toward the open position, a door stop including a base mounted on said door and including an elongated upright guide abutted against said surface adjacent said lower marginal edge, a vertically elongated prop member pivotally mounted at its upper end from an upper portion of said guide for oscillation about a horizontal axis generally paralleling said surface and for movement between a first inoperative downwardly and outwardly inclined position with the lower end of the prop member spaced above the lower marginal edge of said door and a second operative position with the lower end of said prop member swung toward said surface and projecting at least slightly below said lower marginal edge for engagement with a horizontal surface over which said lower marginal edge moves when said door is shifted toward the open position thereof, means operatively connected between said base and prop member yieldingly biasing the latter toward said inoperative position, and elongated tension member means extending between said guide and prop member and including opposite end portions thereof slidably anchored to the guide and prop member for guided gravity movement downwardly therealong and with said tension member means preventing movement of said prop member toward said inoperative position from an operative position thereof independent of upward movement of said tension member means along said prop member and guide, wherein said guide and prop member include registered upstanding slots formed therethrough, said tension member means comprising an elongated tension member having its opposite ends slidably received through said slots and equipped with enlarged head means on the terminal ends thereof disposed on remote sides of said slots, wherein said tension member includes an elongated rigid rod member, the length of said rigid rod member enabling the prop member to swing to said inoperative position when the rigid member is moved upwardly in the slots toward the pivot axis, said rigid member falling by gravity away from the pivot axis as the prop member swings toward said operative position until the lower end thereof contacts the floor, said rigid member automatically and positively retaining the prop member in any position to which it is moved when the lower end contacts the floor.

14. A door stop for selectively preventing swinging movement of a door in one direction comprising a base adapted to be engaged with the face of a door which faces the direction of movement and adjacent the lower edge thereof, a prop member, means pivotally connecting the upper end of the prop member to the base for pivotal movement about a generally horizontal axis, means on the lower end of said prop member for engaging a floor surface when the prop member is in operative position approaching parallelism with the face of the door, the length of the prop member being slightly greater than the vertical distance between the floor and a pivot axis between the base and prop member, means biasing the prop member to inoperative position with the lower end of the prop member spaced from the floor and means interconnecting the base and prop member in spaced relation to the pivot axis to limit movement of the prop member toward said inoperative position, said limiting means including a retainer vertically movable with respect to the prop member and base to enable unrestricted pivotal movement of the prop member toward said operative position, said retainer being gravitationally moved vertically to various positions to prevent movement of the prop member toward said inoperative position after movement of the prop toward said operative position, wherein said base includes a vertically disposed slot, said prop member including a longitudinal slot aligned with the slot in the base, said retainer comprising a rigid member extending through and slidably received in said slots, each end of said rigid member being laterally enlarged to prevent movement through the slots while permitting free sliding movement of the rigid member in relation to the slots, the length of said rigid member is moved upwardly in the slots toward the pivot axis, said rigid member falling by gravity away from the pivot axis as the prop member swings toward said operative position until the lower end thereof contacts the floor, said rigid member automatically and positively retaining the prop member in any position to which it is moved when the lower end contacts the floor with the prop member in acute angular relation to the face of the door thereby preventing movement of the door in one direction until the rigid member is moved toward the pivot axis.

15. The door stop as defined in claim 14 together with means mounting said base adjustably and removably on a door to enable use of the door stop with doors spaced various distances above a floor and to enable the door stop to be carried to a site of use and easily and quickly installed on a door.

* * * * *